US006229500B1

(12) United States Patent
Caille et al.

(10) Patent No.: US 6,229,500 B1
(45) Date of Patent: May 8, 2001

(54) MULTILAYER FOCUSING SPHERICAL LENS

(75) Inventors: Gérard Caille, Tournefeuille; Laurent Martin, Toulouse; Béatrice Pinte, Labege, all of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/424,890

(22) PCT Filed: Apr. 6, 1999

(86) PCT No.: PCT/FR99/00784

§ 371 Date: Nov. 30, 1999

§ 102(e) Date: Nov. 30, 1999

(87) PCT Pub. No.: WO99/52180

PCT Pub. Date: Oct. 14, 1999

(30) Foreign Application Priority Data

Apr. 6, 1998 (FR) ..... 98 04230

(51) Int. Cl.[7] ..... H01Q 15/02; H01Q 19/06

(52) U.S. Cl. ..... 343/909; 343/753

(58) Field of Search ..... 343/753, 754, 343/909, 911 R, 911 L

(56) References Cited

U.S. PATENT DOCUMENTS

| | | | | |
|---|---|---|---|---|
| 3,914,769 | | 10/1975 | Andrews | 343/911 L |
| 4,307,404 | | 12/1981 | Young | 343/754 |
| 4,333,082 | * | 6/1982 | Susman | 343/754 |
| 5,145,973 | | 9/1992 | Newman et al. | 549/397 |
| 5,677,796 | * | 10/1997 | Zimmerman et al. | 343/911 R |
| 5,748,151 | * | 5/1998 | Kingston et al. | 343/753 |
| 5,781,163 | * | 7/1998 | Ricardi et al. | 343/911 R |
| 5,900,847 | * | 5/1999 | Ishikawa et al. | 343/909 |
| 6,081,239 | * | 6/2000 | Sabet et al. | 343/753 |

FOREIGN PATENT DOCUMENTS

| | | | |
|---|---|---|---|
| 0 632 522 A1 | 1/1995 | (EP) | H01Q/1/42 |
| WO 93/10572 | 5/1993 | (WO) | H01Q/19/06 |

* cited by examiner

*Primary Examiner*—Don Wong
*Assistant Examiner*—Hoang Nguyen
(74) *Attorney, Agent, or Firm*—Sughrue, Mion, Zinn, Macpeak & Seas, PLLC

(57) ABSTRACT

The invention concerns a multilayer focusing spherical lens (21) adapted to be mounted in a transceive antenna device (1) of a terminal of a remote transceiver system and having a concentric focal sphere (S), the lens including a central layer (21*a*) and a peripheral layer (21*b*) having different dielectric constants, each dielectric constant value being determined so that the lens (21) focuses parallel microwave beams towards the focal sphere (S) concentric with the lens. A transceive antenna includes a lens of the above kind and a terminal for transmitting and receiving radio signals to and from at least two remote transceiver systems moving at different points in the field of view of the terminal, said terminal including an antenna of the above kind. The invention applies in particular to systems for transmitting data at high bit rates to and from a constellation of satellites, for public or private, civil or military use.

30 Claims, 8 Drawing Sheets

MULTILAYER FOCUSING SPHERICAL LENS

BACKGROUND OF THE INVENTION

The invention relates to a multilayer focusing spherical lens which can be incorporated in a transceive antenna of a terminal of a remote transceiver system.

The invention also relates to a transceive antenna including a lens of the above kind and a terminal for transmitting and receiving radio signals to and from at least two remote transceiver systems moving at different points in the field of view of said terminal, the terminal including an antenna of the above kind.

The invention applies in particular to systems for transmitting data at a high bit rate to and from a constellation of satellites for public or private, civil or military use, but this application is not limiting on the invention.

More generally, the invention relates to any application requiring a lens of simple structure with which a compact antenna can be obtained.

One solution to the problem of simplifying the structure of the lens in an antenna is to use a single-layer focusing spherical lens, of the kind shown in FIG. 1. Such lenses have the advantage that they are easy to manufacture because they comprise only one layer, and possibly also an index matching layer, as shown.

However, for a given overall size, such lenses have relatively low gain, yielding an antenna efficiency of less than 50%. In the example shown in FIG. 1, even though the various parameters of the lens have been optimized, such as the refractive index, the diameter and the losses by reflection limited by the index matching layer, the gain is still low because of the convergent rays, which represent a loss of energy and disturb the radiation pattern of the antenna in the form of raised secondary lobes. Experience shows that reducing the refractive index increases the focal length and therefore increases the overall volume of the antenna, whereas increasing the refractive index increases ohmic losses without improving the focusing of the lens.

One solution to that problem would be to increase the overall size of the lens to obtain satisfactory gain, for example gain of the order of 31 dB in the applications in question. However, this is not acceptable because it leads to overall size and additional weight which are incompatible with minimizing the overall size and weight of a transceive terminal.

A second solution uses a multilayer Luneberg lens, as shown in FIG. 2. Such lenses comprise a plurality of concentric spherical layers of dielectric constant that decreases continuously from the center towards the edge of the lens. That type of lens has the advantage of total spherical symmetry, which is ideal for producing an antenna with a very wide field of view.

However, for given overall size, such lenses also have relatively low gain, yielding an antenna with efficiency of 50% to 60%. FIG. 2 shows divergence of many rays despite relatively fine sampling of the theoretical law stated by Luneberg. To obtain high efficiency it is necessary to increase the number of layers considerably, which is totally prohibitive in terms of manufacturing cost, especially for mass-market applications.

Finally, U.S. Pat. No. 4,307,404 describes a planar and spherical multilayer antenna design and refers to a spherical artificial structure.

However, the problem addressed in the above document is concerned with interference between different frequencies. Consequently, the beam is deflected for certain frequencies only and the antenna described is therefore not a particularly broadband antenna: the beam is swept mechanically in the same direction for all frequencies compatible with the radiating source.

SUMMARY OF THE INVENTION

The object of the present invention is to overcome the aforementioned disadvantages.

The invention consists in a focusing spherical lens whose structure is simple and compact and whose manufacturing cost is small compared to that of prior art lenses.

The invention further consists in a lens of the above kind whose performance, and in particular whose efficiency, is better than that of prior art lenses.

To this end, in a first aspect, the invention proposes a multilayer focusing spherical lens adapted to be mounted in a transceive antenna device of a terminal of a remote transceiver system and having a concentric focal sphere, characterized in that it has a central layer and a peripheral layer having different dielectric constants, each dielectric constant value being determined so that the lens focuses parallel microwave beams towards the focal sphere concentric with the lens.

The two-layer structure of the lens improves focusing and therefore assures a simple structure whilst reducing the volume of the lens compared to that of prior art lenses. Of course, this presupposes that the two dielectric constant values, the intermediate radius, and the position of the source have all been optimized. This achieves efficiency of 70% to 80%, which is entirely satisfactory for the applications concerned.

In one embodiment of the invention, the lens includes an index matching layer adapted to reduce losses by reflection at the lens dielectric/air interface.

The index matching layer reduces losses and coupling generated by reflection phenomena at the surface of the spherical lens.

In another embodiment of the invention the values of the dielectric constants of the two layers are in the range from 2 to 5.

In a second aspect, the invention proposes an antenna for transmitting and receiving radio signals to and from at least one remote transceiver system moving in the field of view of said antenna, characterized in that it includes a focusing spherical lens as previously mentioned.

In a third aspect, the invention proposes a terminal for transmitting and receiving radio signals to and from at least two remote transceiver systems moving at different points in the field of view of said terminal, characterized in that it includes means for determining the position of said remote transmitters/receiver in view at a given time, means for choosing a remote transceiver, an antenna having one primary source (23, 24) for transmitting and receiving signals in the form of quasi-spherical wave beams which is mobile over a portion of the focal sphere (S), and means (10) for slaving the position of each primary transceive source to the known position of a remote transceiver system, including at least two primary transceive sources, means for controlling movement of the primary transceive sources over the focal sphere adapted to prevent the primary sources colliding and means for switching between the primary sources.

In an embodiment of the terminal, each primary source, mounted on a support, is moved by at least one pair of motors so that each source is moved over at least the lower half of the focal sphere.

In a first variant, each primary source is moved by a pair of azimuth/elevation motors.

In a second variant, each primary source is moved by an X/Y motor pair, the first motor rotating each primary source about a horizontal primary axis Ox and the second motor rotating each primary source about a secondary axis Oy orthogonal to said primary axis at all times and moved relative to the primary axis by the first motor.

In a third variant, a first primary source is moved by an azimuth/elevation motor pair and the second primary source is moved by an X/Y motor pair, the azimuth motor of the first primary source also driving the antenna as a whole.

In a fourth variant, each primary source is moved by a pair of motors with oblique rotation axes.

BRIEF DESCRIPTION OF THE DRAWING

Other features of the invention are explained in the following description of non-limiting embodiments of the invention, which is given with reference to the accompanying drawings.

DETAILED DESCRIPTION OF THE INVENTION

Figure 1:
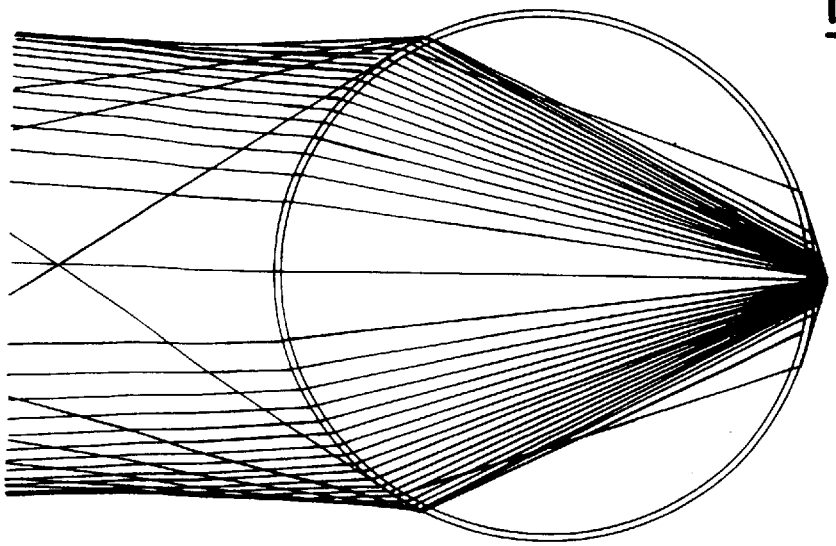
FIG. 1 is a plan view of a prior art single-layer focusing spherical lens.
Figure 2:
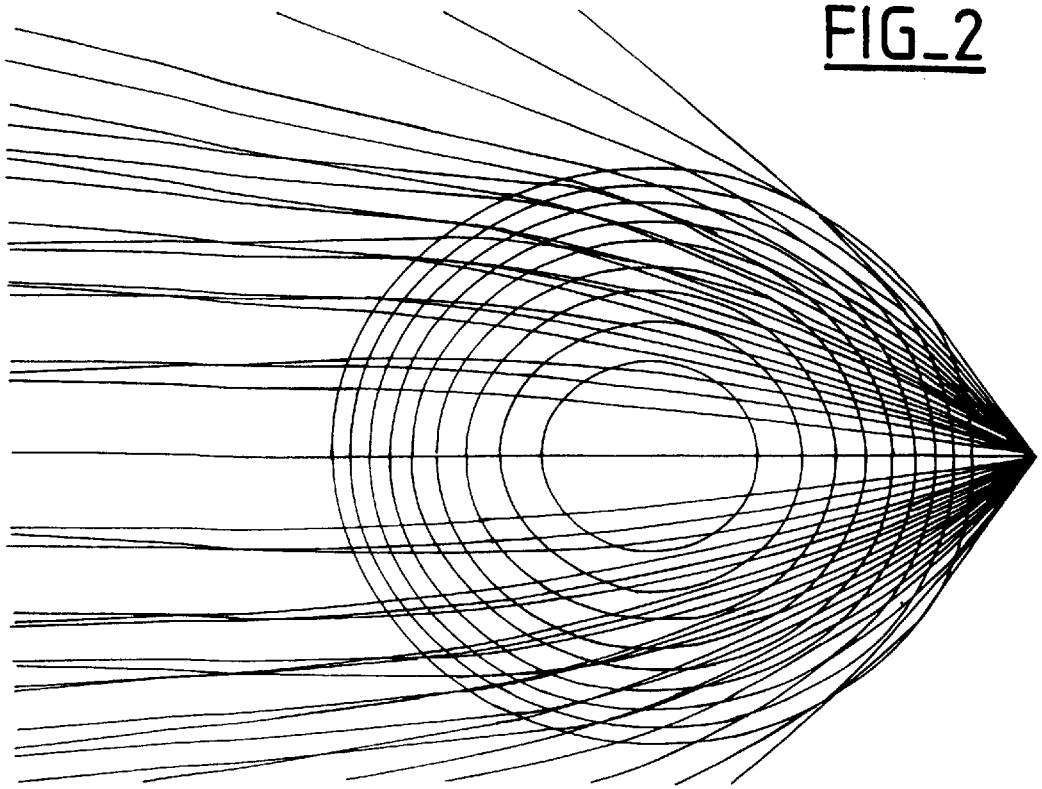
FIG. 2 is a plan view of a prior art Luneberg multilayer focusing spherical lens.
Figure 3:
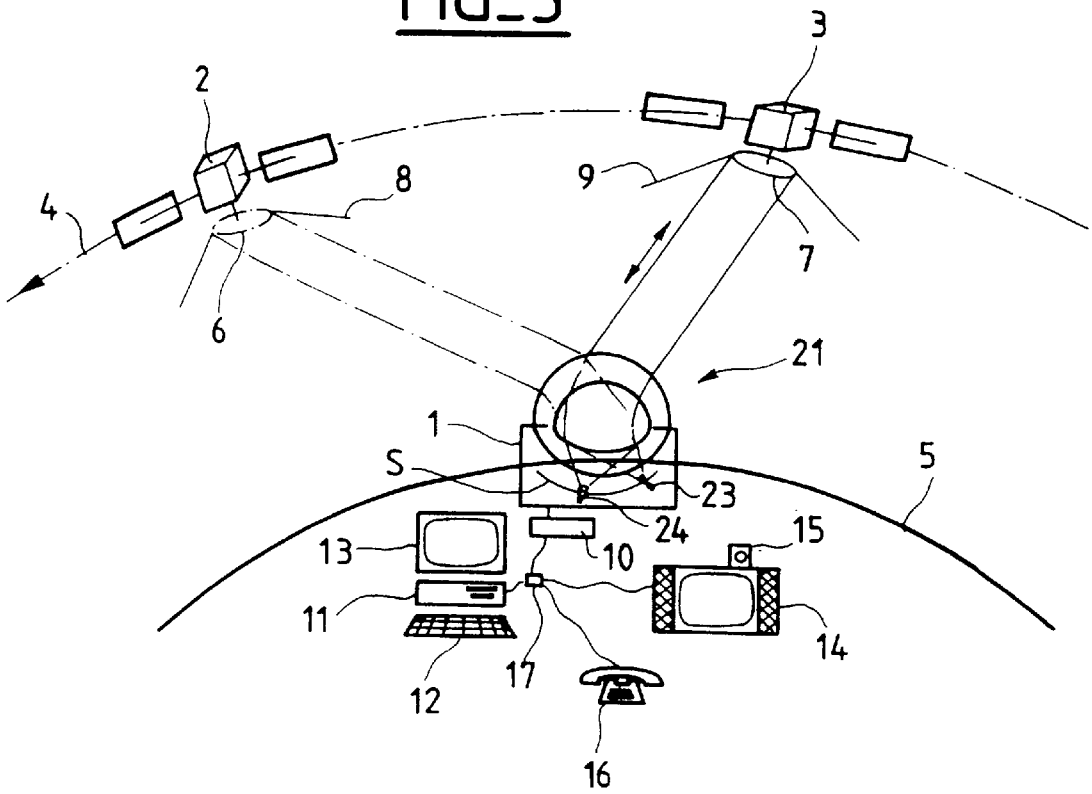
FIG. 3 is a diagram showing a terminal in accordance with the invention and the elements of the satellite transmission system into which it is integrated.

FIG. 3 shows an antenna 1 which can be seen from two satellites 2, 3 traveling in an orbit 4 around the Earth 5. The orbits of the satellites are deterministic and known long in advance. However, the satellites are subject to drift (limited to approximately ±0.1° as seen from a terminal) associated with residual atmospheric drag and with the pressure of solar radiation and which is corrected at regular intervals by the motors of the satellite. The satellites carry receive and transmit antennas 6, 7 transmitting high-power signals in directional beams 8, 9.

A private individual or a business using the data transmission system is provided with a terminal-antenna including an antenna 1 fixedly installed on the roof, like a standard satellite TV antenna, for example. The terminal-antenna (for a transceive terminal) also includes electronics 10 for tracking satellites, transmitting and receiving radio signals and decoding encrypted information for which the user has an authorization (subscription). The terminal-antenna is also connected to a personal microcomputer (PC) 11 including a memory system, not shown, a keyboard 12 and a screen 13. The memory system of the microcomputer stores information characterizing the orbits of the satellites (ephemerides updated periodically by signals from the stations) and software for calculating the local geographical angles (azimuth, elevation) of the visible satellites assigned to it by the station (gateway) managing the area concerned, on the basis of the above orbital information and of the geographical location (longitude and latitude) of the terminal-antenna.

In another embodiment the terminal-antenna can be connected to a television 14 for receiving broadcasts on command, and the television can be equipped with a camera 15 for videoconferencing applications, a telephone 16 and a facsimile machine, not shown. Both types of user interface (PC and TV) can be present at the same time, in which case the various systems requiring to transfer data via the terminal-antenna are connected to a connecting box 17 which could be integrated into the unit 10 containing the terminal-antenna electronics.

To be more precise, the antenna 1 includes a focusing spherical lens 21 having a focal sphere S.

In accordance with the invention, the focusing lens has two layers, namely a central layer 21*a* and a peripheral layer 21*b*, having different dielectric constants, each dielectric constant value being determined so that the lens focuses parallel microwave beams towards the focal sphere S concentric with the lens.

The determination of each dielectric constant value can also allow for the fact that the paths of the microwave beams must be equal, that the density of power between two consecutive rays sampling the source pattern is constant, namely that the source pattern is matched to the spatial distribution of the energy received by it, and that the reflections at the interface between the two layers are weak. In the second case, this maximizes the gain of the antenna by generating a quasi-uniform energy tube at the exit from the lens.

It may be necessary to reduce reflections at the dielectric/air interface of the lens to improve the performance of the antenna. An index matching layer 22 one quarter-wavelength thick can then advantageously be provided at the periphery of the lens. It is advantageously in the form of a dielectric coating, for example, whose index is equal to the square root of the index of the dielectric of the peripheral layer. In another embodiment a plurality of blind holes extend to a thickness of one quarter-wavelength with a density such that the average index of the remaining dielectric and the index of the air in the holes is equivalent to an index equal to the square root of the index of the dielectric of the peripheral layer 21*b*. This is a standard method, and amounts to "simulating" a dielectric of particular permittivity. The blind holes can equally be replaced by crossed grooves.

The central layer 21*a* and peripheral layer 21*b* of the spherical lens contain a low-loss material of moderate density.

For example, the central layer 21*a* is of glass and the peripheral layer 21*b* is of a dielectric material with a variable dielectric constant, such as a foam charged with calcium or barium titanate and/or miniature balls of metallized glass.

Figure 4:
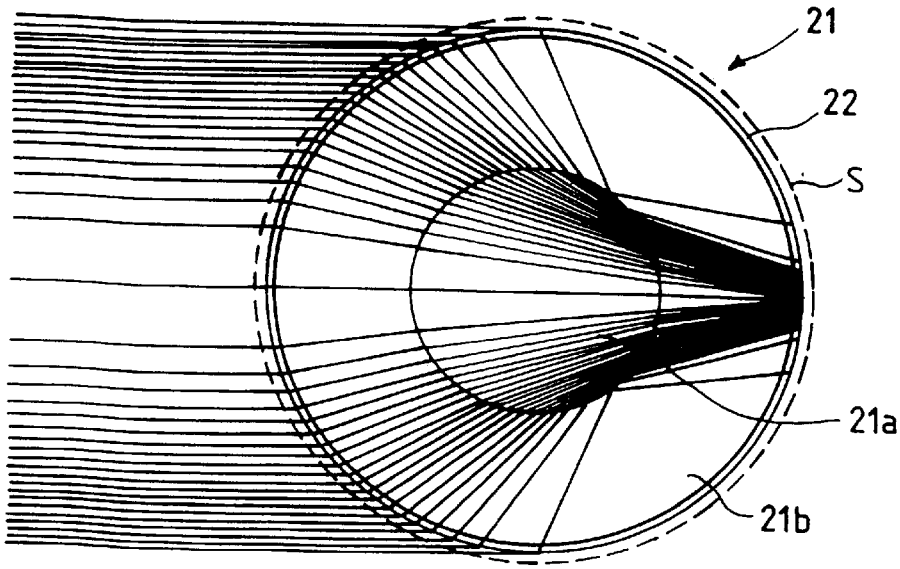
FIG. 4 is a plan view of a two-layer focusing spherical lens in accordance with the invention.

To optimize the characteristics of the lens 21, and consequently those of the antenna 1, the values of the dielectric constants of the central layer 21*a* and the peripheral layer 21*b* are in the range from 2 to 5. In the embodiment shown in FIG. 4, an optimum pair of values is in the order of 4.5 for the peripheral layer 21*b* and 3.7 for the central layer 21*a*.

The antenna 1 also includes two primary sources 23, 24 for transmitting and receiving spherical wave beams and a mechanical assembly shown in FIGS. 5, 8, 10, 11, 12 and 13 for positioning the primary transceive sources.

The two primary transceive sources 23, 24 of spherical waves can move over a portion of the focal sphere S of the focusing lens. They are horn antennas of the standard type used for satellite TV reception, for example, in which application horns illuminated by parabolic reflectors are used.

The specific characteristics of the horns employed here are related to the angle within which they see the focusing lens and to the wavelength employed. With regard to the data bit rates, for varied applications including interactive games, teleworking, teleteaching, interactive video and Internet type transmission of data it is necessary to consider a maximum transmitted volume in the order of 1 Mbps to 5 Mbps and a maximum received volume one order of magnitude greater, i.e. from 10 Mbps to 50 Mbps. Also, to produce a compact antenna, the position of the horns is as close as possible to the spherical lens: their usable radiating cone being very wide, their mouth diameter will be small, from 20 mm to 25 mm in this example of a system operating in the Ku band, i.e. at frequencies from 11 GHz to 14.3 GHz.

A simple mechanical assembly for moving the two sources over a portion of the focal sphere has the two mobile sources moved by an azimuth/elevation motor pair for each source.

Figure 5:
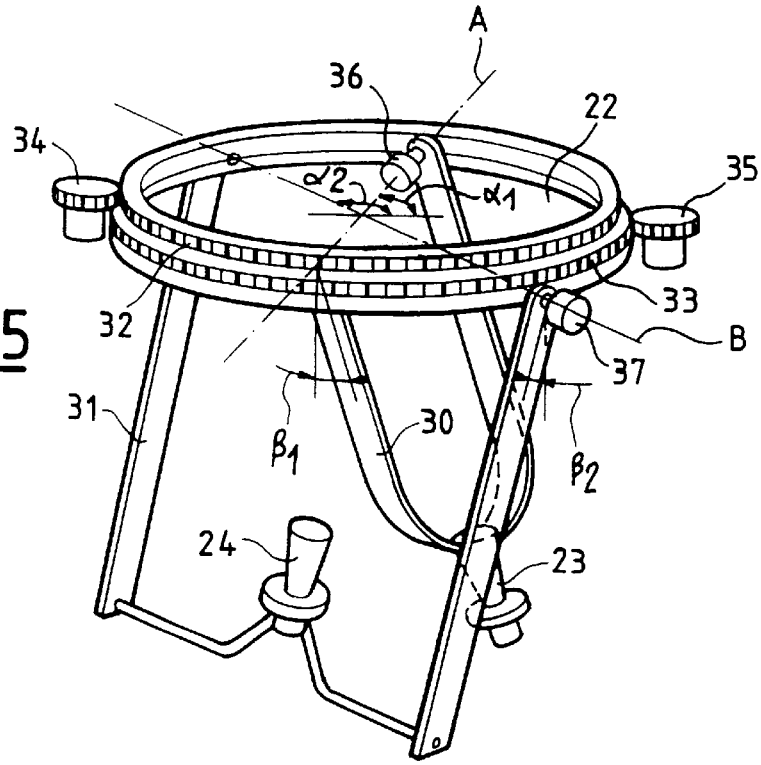
FIG. 5 is a diagram showing a first embodiment of a mechanical system for moving primary transceive sources over a portion of the focal sphere of the focusing lens using azimuth/elevation motor pairs.
Figure 8:
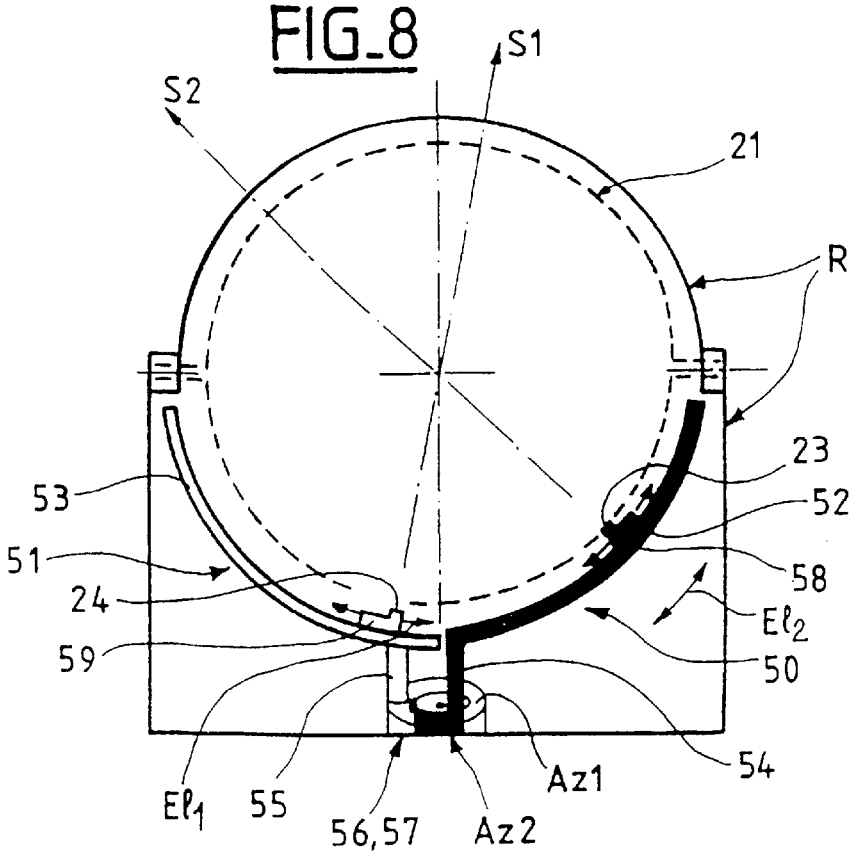
FIG. 8 is a diagram showing a second embodiment of a mechanical system for moving primary transceive sources over a portion of the focal sphere of the focusing lens using azimuth/elevation motor pairs.

FIGS. 5 and 8 show two embodiments of this type of assembly.

FIG. 5 shows a simple mechanical assembly in which two horns move independently of each other. The support for the sources includes a double concentric ring 32, 33 and swings 30, 31 supporting the horns 23, 24. To ensure that the sphere portion determined by the axis of freedom of the horns in this configuration corresponds to the focal sphere of the focusing lens 21, the lens is disposed at the center of the double ring on standard mechanical support means, not shown here.

In this configuration, the first horn 23 is moved by an assembly "inside" the support of the other horn 24. The top of the first horn 23 is attached to a rigid plastics material swing type support structure 30 with two arms of circular arc shape in the lower part to avoid impeding the movement of the other swing 31 supporting the second horn 24. The swing 30 is attached to an inner ring 32 about an axis A.

The swing is moved about the vertical axis by an inclination motor 36, for example an electrical stepper motor disposed on the axis A inside the ring 32. This movement produces an inclination $\beta 1$ in the range from −80° to +80°. This inclination is a function of the elevation of the satellite: it is zero for a satellite at the zenith of the location and ±80° for a satellite 10° above the horizon of the location.

The inner ring 32 is rotated by another electric stepper motor 34 providing an azimuth angle $\alpha 1$ in the range from 0° to 360°. This motor is outside the two rings, for example, and rotates the inner ring via a toothed ring.

Clearly the combined action of the azimuth motor 34 and the inclination motor 36 can place the first horn 23 at any chosen point on a dome of the focal sphere within an aperture angle of ±80°, the horn pointing towards the center of the focusing lens at all times. The two motors 34 and 36 are controlled to track a non-geostationary satellite, the speed of the satellite corresponding to movement of the horn from a −80° elevation position to a +80° elevation position in approximately ten minutes, for example.

The azimuth motor 34 and the inclination motor 36 constitute an azimuth/elevation motor pair.

If the system shares the same frequency bands as geostationary satellites (as is the case in the Ku band), non-interference with them is assured by switching the traffic to another satellite as soon as the satellite which is being tracked comes within 10° of the geostationary arc, in terms of the angle as seen from the terminal.

The support for the second horn is very similar to that described above for the first horn. The bottom part of the horn 24 is attached to a swing structure 31 whose size is such that it does not impede the movement of the inner swing. This swing is suspended from an outer swing. The azimuth angle $\alpha 2$ of the antenna 24 is determined by an azimuth motor 37 and the inclination angle $\beta 2$ by an inclination motor 35 which are in all respects identical to the positioning motors of the other antenna.

The control and power supply electronics of the azimuth/inclination stepper motors of the horns are not described here but will be clear to the person skilled in the art.

Figure 6:
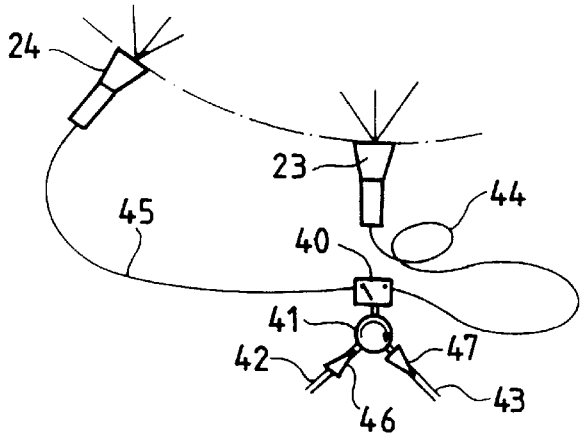
FIG. 6 shows an electronic circuit for switching signals of primary transceive sources of the mechanical system shown in FIG. 5.

FIG. 6 shows the electronics for switching between the two horns 23, 24. A transmit signal channel 42 includes a Solid State Power Amplifier (SSPA) 46 and a receive signal channel 43 includes a Low-Noise Amplifier (LNA) 47. The two channels are connected to a circulator 41. The circulator is a standard passive component circulating the signal in a given direction between its three ports and providing transceive decoupling. It is made of ferrite, for example. The circulator 41 is connected to a switch 40 for selectively connecting one or other of the horns. The switch 40 is connected to the horns by flexible coaxial cables 44, 45. It is a standard diode-based switch and switches between the two horns in less than one microsecond. Ancillary components not mentioned in this description, such as the electrical power supply, are standard in the art.

The operation of the system comprises a number of phases. The first phase is installation of the system. This includes mechanically fixing the antenna to the roof of a building and verifying the horizontal axes and the north/south orientation of the antenna. The antenna is then connected to its power supply, to a control microcomputer 11 and to user systems in the form of a TV 14, a camera 15 and a telephone 16.

During this same phase the orbital position and speed parameters at a given initial time (ephemerides) of each satellite of the constellation are entered into the memory of the host computer controlling the antenna. This data can be supplied on diskette.

After the local time and the terrestrial position (latitude, longitude) of the terminal-antenna have been entered, the computer can calculate the current position of the satellites of the constellation according to the time that has elapsed since the time corresponding to the stored orbital parameters and compare those positions to the theoretical field of view of the terminal-antenna. The system can be calibrated automatically, including pointing the horns 23, 24 at the theoretical positions of the visible satellites, tracking them briefly and verifying from the data acquired the power level received and transmitted, the spatial orientation of the antenna and the quality of tracking. A diagnosis of corrections required to the installation is produced automatically from this calibration data.

During the phase of routine use, when the user starts up the system (by booting up the computer and powering up the antenna), the control software calculates the position of the satellites at the time and determines which satellites are visible at the time from its location. The station assigns it a visible satellite according to the data bit rate (and therefore bandwidth) of the satellites available at the time. The computer 11 calculates the corresponding position required for a horn on the focal sphere of the focusing lens, sends instructions to the stepper motors which move that horn and connects the horn corresponding to the most visible satellite to the transmit and receive electronics. It is then possible to transmit and receive data.

The computer then continuously calculates corrections to the position of the horn to track the satellite and drives the positioning motors accordingly. The accuracy of positioning required for regular tracking of the satellites is determined by the width of the main lobe of the antenna and the acceptable attenuation of the signal before the antenna is moved. In the present example, a lobe aperture of 5° and an acceptable signal loss of 0.2 dB lead to an accuracy of 0.50° for pointing of the horn by the motors, which for a typical focal sphere having a radius of 20 cm corresponds to a positioning accuracy of 2 mm. Tracking a non-geostationary satellite at an altitude of approximately 1500 km therefore requires a maximum horn speed of approximately 1 mm/s. When tracking a satellite, movement of the horn handling the stream of calls has a higher priority than movement of the other horn, the software assuring at all times that no collisions occur by moving the second horn out of the path of the first one if necessary.

The computer determines the second most visible satellite on the basis of criteria such as a satellite elevation less than 10° (satellite approaching the horizon) or an abnormal drop in the level of the received signal (allowing for trees, hills and other local, permanent or temporary obstacles, or entry into the band near the geostationary arc, in which interference to or from geostationary satellites makes it obligatory to cut off the link), and, after a short dialogue with the station to verify that bit rate is available on that satellite, positions the second horn in a manner corresponding to that position. The second horn is then connected and the satellite is tracked. The time to switch between the two horn antennas, which is 1 microsecond in the embodiment described, leads to a maximum loss of data of approximately 1 bit to 50 bits for a maximum transmitted data bit rate of 1 Mbps to 50 Mbps. Lost data is reconstituted using error-correcting codes transmitted with the signal.

The ephemerides is periodically updated from the station managing the area in which the terminal is located, via the satellite network itself.

As indicated in the foregoing description, the motors used in this assembly have a power rating suited to moving a small mass, a few hundred grams at most, which enables the use of low-cost motors available off the shelf. This is an advantage compared to the satellite tracking solution using two antennas, for which the motors must be able to position accurately masses of a few kg, and are therefore more costly.

A standard mechanical assembly and simple electronics can guarantee the levels of accuracy required in positioning the antenna and the time between two movements. The chosen solution is therefore clearly economic to manufacture.

The embodiment of the invention described provides a compact low-cost system, the various components being standard components or having undemanding manufacturing specifications.

Note that the motor drive system and the supports are protected by a cylindrical radome R (FIG. 8) which terminates at the top in a hemisphere close to the lens; the windage is such that the wind direction is immaterial and has a low drag coefficient, which represents an advantage over standard antennas with no radome, which causes problems of movement due to gusts of wind.

Figure 7:
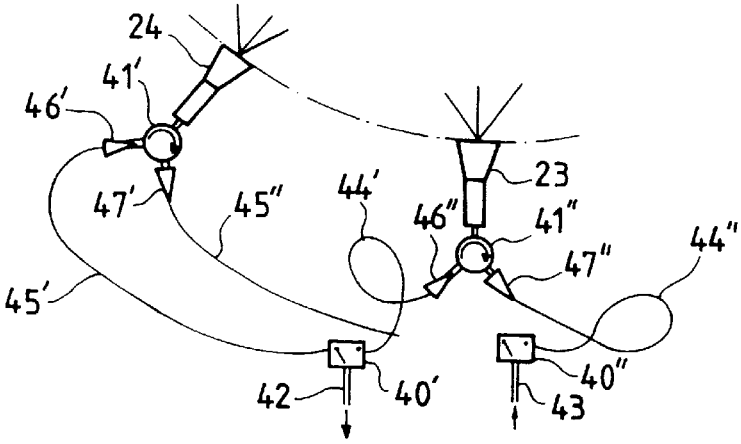
FIG. 7 shows a variant of the FIG. 6 circuit.

In another embodiment, the electronics for switching between the two horns 23, 24 are replaced by the system shown in FIG. 7. In this system, each horn 23, 24 has a circulator 41', 41" to which the transmit signal amplification modules 46', 46" and the receive signal amplification modules 47', 47" are connected directly. The transmit signal amplifiers of the two primary sources are connected by two coaxial cables 45', 44' to a selective connection system 40' which receives the signals to be transmitted via a channel 42. Similarly, the receive signal low-noise amplifiers are connected by coaxial cables 45", 44" to a selective connection system 40" connected to a receive signal channel 43.

This arrangement is intended to reduce the impact of signal losses occurring in the flexible coaxial cables and estimated at around 1 dB in each cable, whose length including the relaxation loops is estimated at 70 cm to 90 cm. This embodiment has a higher cost because of the duplication of the amplifiers, but for the same amplifier power it increases the Equivalent Isotropically Radiated Power (EIRP) by approximately 1 dB and the receive figure of merit (G/T) by approximately 2 dB. For equal antenna performance, this enables the dimensions of the spherical lens, and therefore the entire antenna, to be reduced.

In a variant of the method of tracking satellites, an active technique replaces the passive technique described above, in which the data characterizing the position of the satellites is merely pre-stored in the memory of the computer and it is assumed that the primary sources are positioned in this way at the correct location and at the correct time, with no real time control. In this variant, each horn includes a plurality of receivers, for example four receivers in a square matrix, and supplies output signals corresponding to a sum and a difference of the signals received by the various receivers. At the start of tracking a given satellite, one horn is positioned in accordance with the data calculated by the computer 11. Analyzing the evolution with time of the sum and difference signals then indicates in which direction the satellite is moving so that it can be tracked accordingly. The host computer can regularly and automatically update the stored ephemerides as a function of the positions of the satellites as really observed.

In another variant, not shown, in which the user has no microcomputer, the satellite tracking software and the memory for storing the ephemerides are integrated into a microprocessor with memory, for example in a TV set-top box of a size typical of standard encrypted TV set-top decoders, and which can be combined with a modulator/demodulator for encrypted transmission. A procedure is then provided for automatically downloading the ephemerides at regular intervals, without requiring user intervention.

Note that in all the previous embodiments, if the operating band of the multimedia system is the same as that of direct broadcast TV satellites, the two sources can be placed at positions suitable for aiming at two geostationary satellites: the same terminal-antenna is then used alternately for the multimedia application and for receiving broadcasts from two satellites, which can be changed at will by moving the sources.

In a further embodiment, a system similar to that of the invention is installed on a satellite, for example a remote Earth-sensing satellite, which has to transmit images to only a few ground stations which can occupy any position, and is not part of a terminal on the ground. The principle of tracking ground stations from the satellite is analogous to that of tracking satellites from a ground terminal. In this application, the size of the ground stations can be very much smaller (for example by a factor of 10 if a 20 dB gain is applied to the signal received by the antenna), compared to standard receive antennas for satellites transmitting a broad beam, where the received power is low. This arrangement can also enhance the confidentiality of the transmitted data. Finally, the simplicity of the solution, its low cost (in particular compared to active antennas with very large numbers of elements) and its low electrical power consumption make its implementation on a satellite particularly beneficial.

Figure 9:
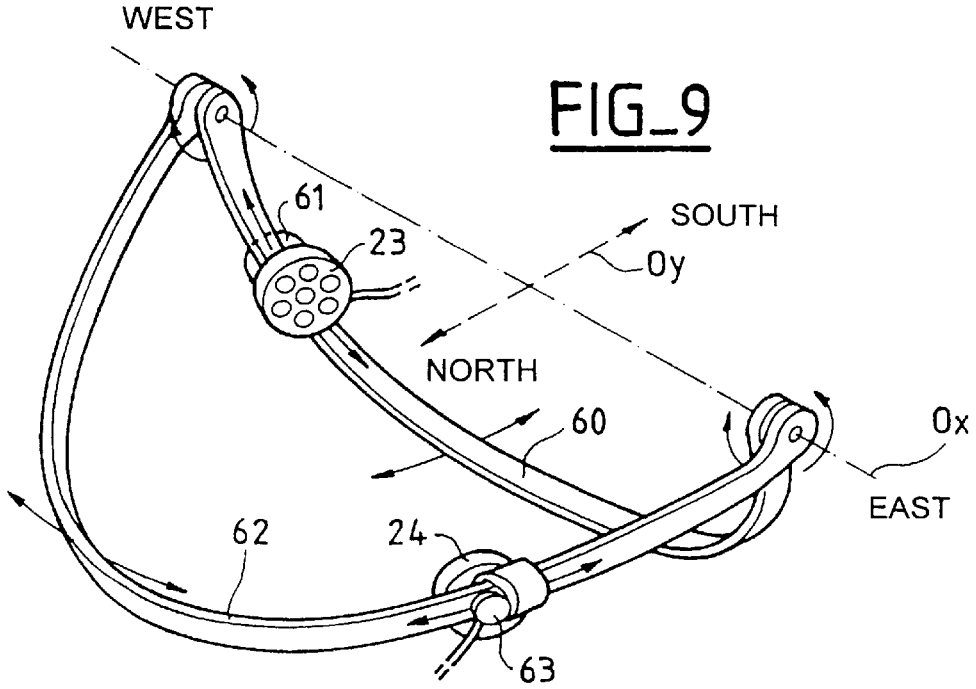
FIG. 9 is a diagram showing one embodiment of a mechanical system for moving primary transceive sources over a portion of the focal sphere of the focusing lens using X/Y motor pairs.
Figure 10B:
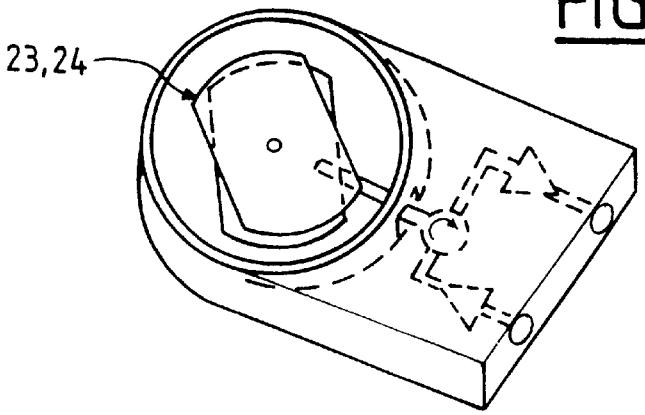
FIG. 10 comprises a diagrammatic perspective view (FIG. 10*a*) and a diagrammatic sectional view (FIG. 10*b*) of one embodiment of the primary transceive sources.
Figure 10A:
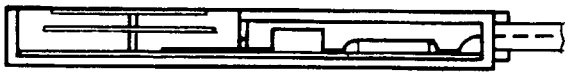

In another embodiment of the invention, shown in FIG. 9, the sources of the antenna are printed circuit "patches". There can be one patch per source (FIGS. 10*a*, 10*b*) or the patches can be grouped into small arrays (FIG. 9) for compensating any aberrations of the focusing system. The variant with patches, being more compact, is particularly beneficial in the case of spherical lenses because it significantly reduces the overall size of the terminal-antenna.

It is also feasible to consider a system with three sources, one of which points to a satellite in the geostationary arc at all times. An arrangement like this uses a single antenna for multimedia applications at a high data bit rate via non-geostationary satellites (which require two mobile sources) or reception of direct broadcast TV pictures from a geostationary satellite (even if it uses a frequency band other than that used by the multimedia system), at the choice of the user and with no delay for repositioning the mobile sources.

For example, if the lens remains fixed, a source glued to the lens receives the television transmissions and at the same time the two mobile sources provide the tracking and switching functions necessary for the multimedia mission.

If the lens turns, in particular to reduce masking by the supports (as in the arrangements shown in FIGS. 13 and 14), the third source can be mounted on a support mobile relative to the lens and the other two sources.

Other embodiments of the mechanical assembly for moving the two sources over a portion of the focal sphere will be described hereinafter. Of course, the various embodiments previously described of the electronic circuit for switching the sources, the method of tracking the satellites and the sources themselves can be applied to what follows.

FIG. 8 shows a variant of the mechanical assembly with azimuth/elevation motors shown in FIG. 5. Each source 23, 24 is mounted on a support arm 50, 51 including a circular arc 52, 53 concentric with the focal sphere S respectively positioned on one half of the lower part of the focal sphere and a rotational drive shaft 54, 55 parallel to the vertical and coupled to an azimuth motor 56, 57. In this way the primary sources 23, 24 are mobile along respective separate azimuth directions Azi and Az2.

Also, each primary source 23, 24 is guided over its circular arc 52, 53 in a slideway for its movement in elevation El1, El2 by elevation motors 58, 59, and which in the example chosen is in the range from 1° to 80°. The movements in elevation El1 and El2 define the sighting axes S1 and S2 of the two visible satellites.

In another variant of the mechanical assembly supporting the mobile sources, shown in FIG. 9, each primary source 23, 24 is moved by an X/Y motor pair. A semi-circular arc 60 is attached at two directly opposite points of the focal sphere, for example its East and West points. One source 23 is moved along this arc, which provides a slideway, by a secondary electric motor 61 attached to the source. The second source 24 is identically mounted on another arc 62 and is moved by a secondary motor 63. Although this feature is not shown, each semi-circular arc 60 and 62 is rotated about its primary axis Ox by a primary motor constituting the second motor of the X/Y motor pair, the circular arc 60 having a smaller radius than the circular arc 62. The secondary motors 61 and 63 therefore move the sources about a secondary axis Oy which is itself moved relative to the primary axis by the primary motors, the secondary axis Oy being always orthogonal to the primary axis Ox. In order to avoid conflicts between the positions of the sources one of the sources transmits to and receives from the "North" satellites and the other one transmits to and receives from the "South" satellites. Relative repositioning of the two arms or arcs is possible if one passes under the lens.

The systems shown in FIGS. 8 and 9 have the advantage over the systems shown in FIGS. 5 and 7 of compactness. They are also better suited to obtaining high angles of illumination of the lens by the sources, which is necessary when using a focusing spherical lens.

Figure 11:
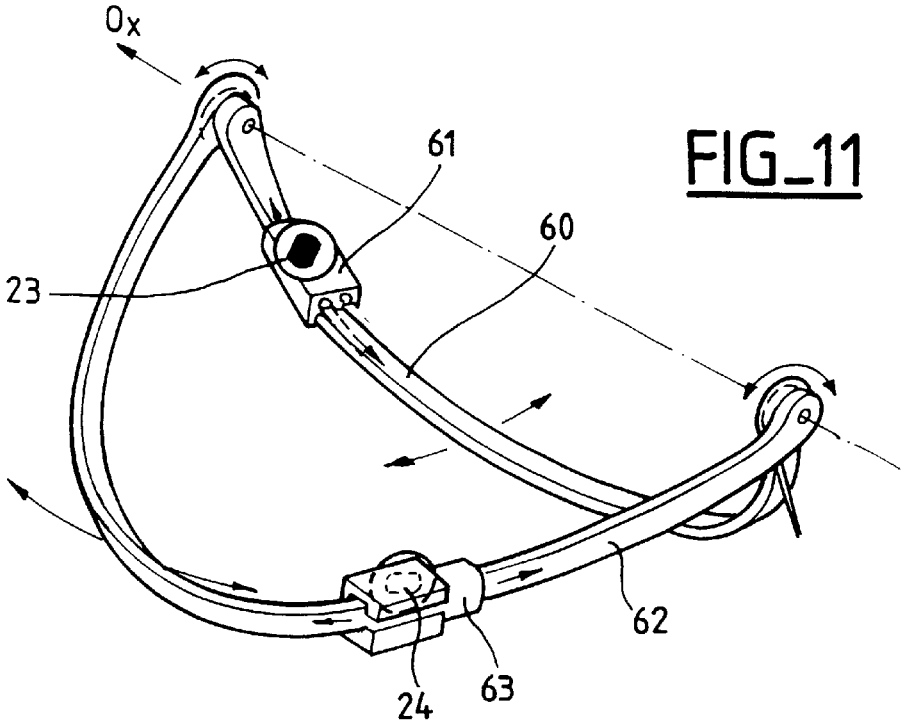
FIG. 11 shows the mechanism shown in FIG. 8 with primary transceive sources mounted on it which are as shown in FIG. 10.

In another variant of the connection of the amplifiers mounted in front of the primary sources, using a mechanical assembly of the sources as shown in FIGS. 9 and 11, each arc is a waveguide and therefore conveys the microwave signal and a standard rotary joint is mounted at the articulation of the arcs. This arrangement reduces signal losses and so the amplifiers can be at a greater distance from the primary sources.

Another variant, replacing cables connected to the primary sources, consists in using optical fibers to transmit and/or receive signals. The fibers have the advantage of flexibility in tracking movement of the source and amplifier combination. The support can itself be used as an optical conductor to transmit information on movement of the motor driving the primary source.

The system then includes a light-emitting diode with a bandwidth of a few hundred MHz and a photodiode for receiving optical data. A mirror is disposed at the attachment point of the arcs to transmit light towards the optical conductor tube.

The tube can also transmit an electrical power supply current for the primary source, the amplifier and the motor, having two spaced conductive tracks and contactors at the source to receive the current.

Figure 12:
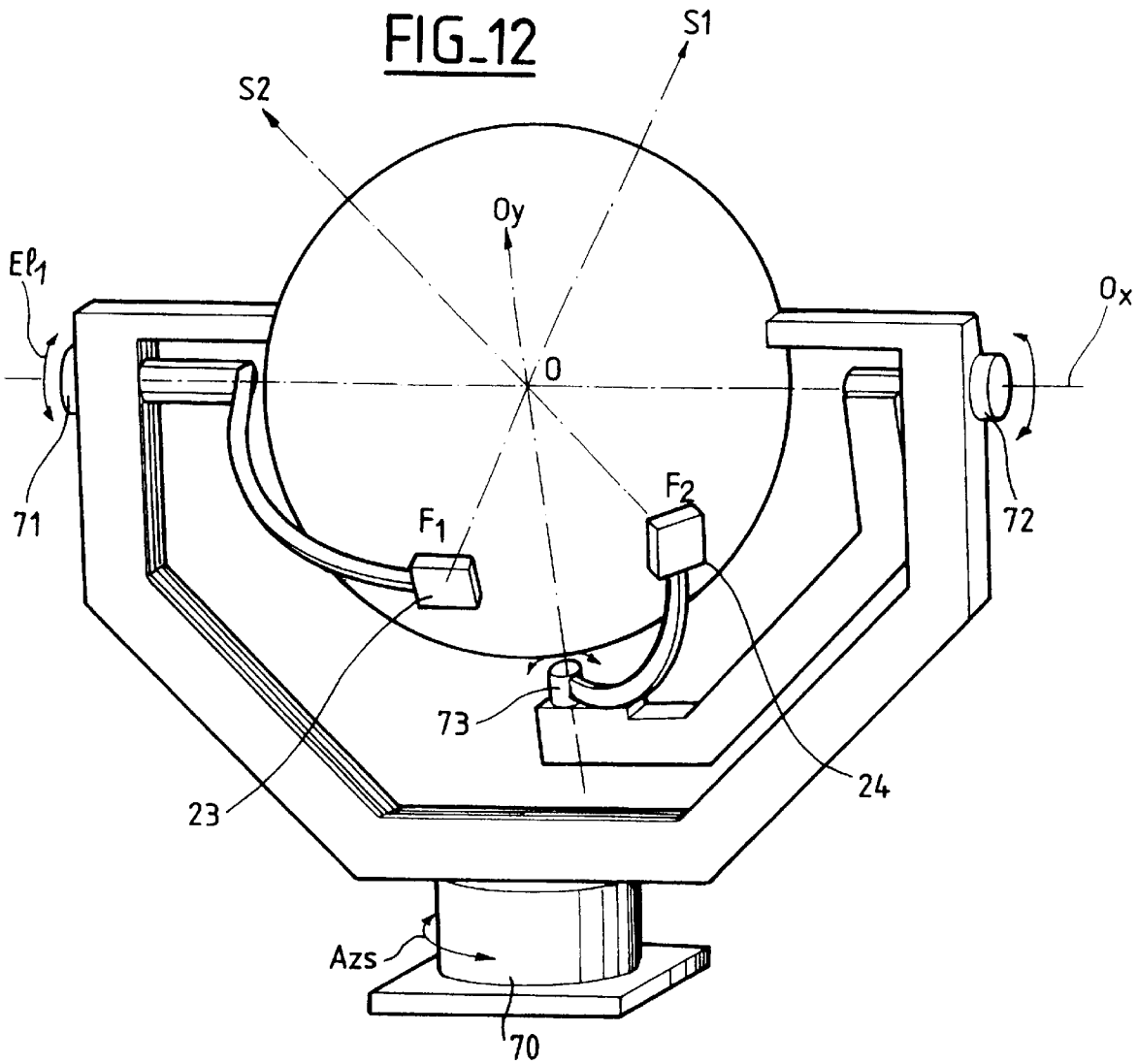
FIG. 12 is a diagram showing one embodiment of a mechanical system for moving primary transceive sources over a portion of the focal sphere of the focusing lens using azimuth/elevation and X/Y motor pairs.

In another variant of the mechanical support assembly for the mobile sources, shown in FIG. 12, a first primary source 23 is moved by an azimuth/elevation motor pair 70, 71 and the second primary source 24 is moved by an X/Y motor pair 72, 73, the azimuth motor 70 of the first primary source also driving the antenna as a whole.

Figure 14:
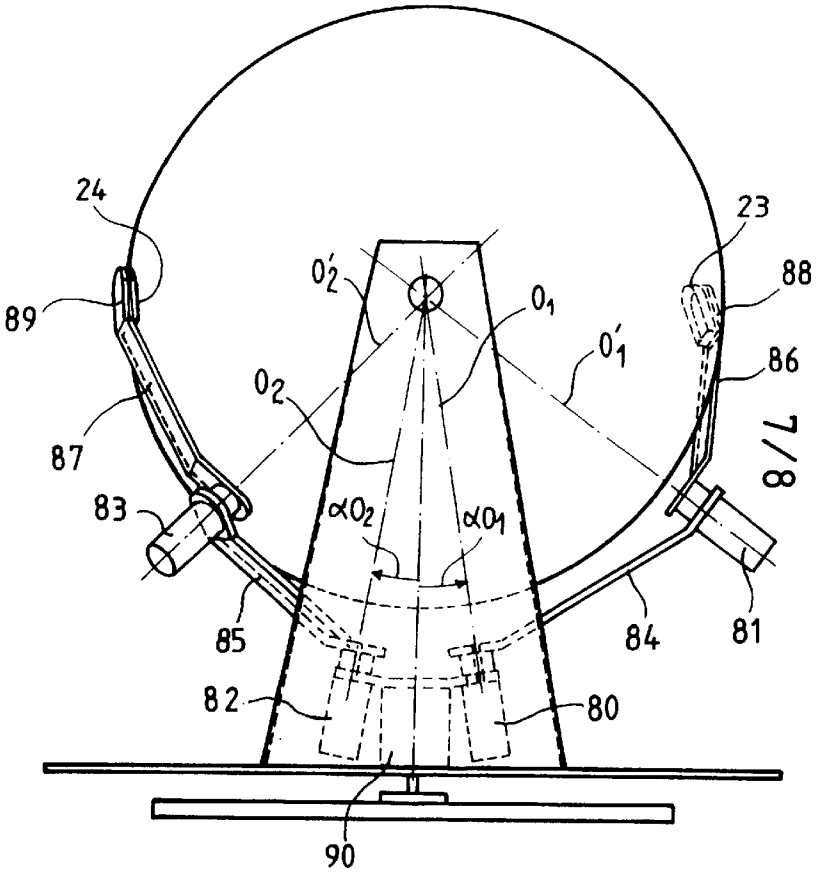
FIG. 14 shows the embodiment shown in FIG. 13 when both sources are active.
Figure 13:
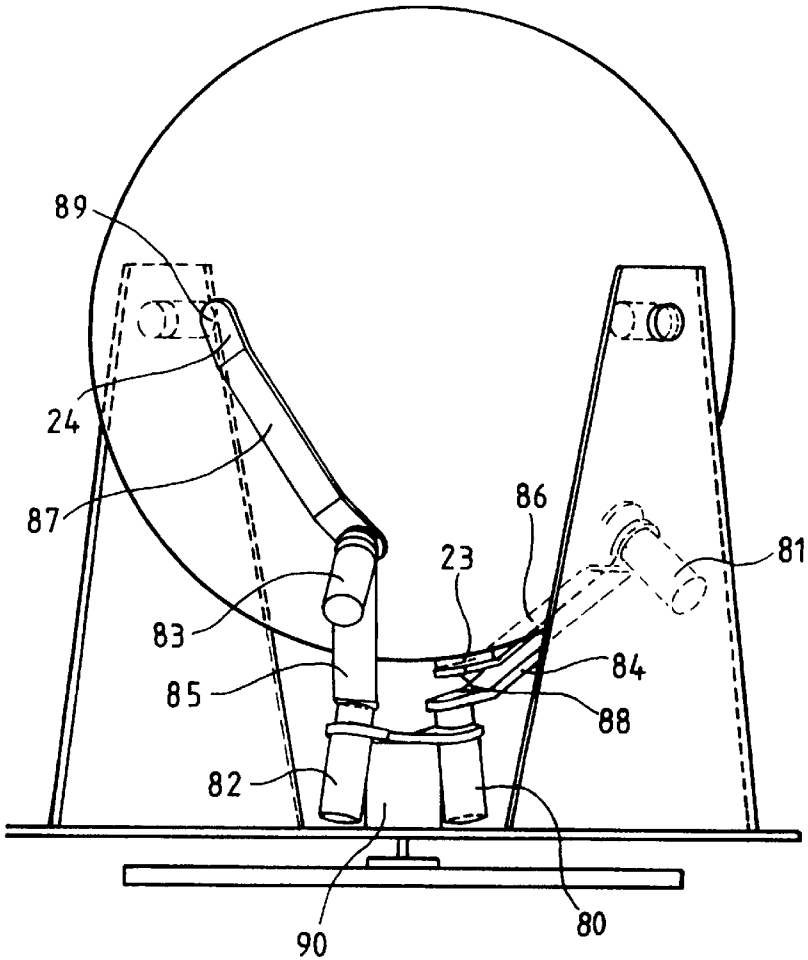
FIG. 13 is a diagram showing one embodiment of a mechanical system for moving primary transceive pairs over a portion of the focal sphere of the focusing lens using motor pairs with oblique axes when only one source is active.

In another variant of the mechanical support assembly of the mobile sources, shown in FIGS. 13 and 14, each primary source 23, 24 is moved by a pair of motors with oblique rotation axes 80, 81 and 82, 83.

Each primary source support includes an arm 84, 85 and a forearm 86, 87, the primary source 23, 24 being fixed to the free end 88, 89 of the forearm 86, 87. The first motor 80, 82 drives the arm 84, 85 in rotation about an oblique primary axis $O_1$, $O_2$ offset by a primary angle $\alpha_{01}$, $\alpha_{02}$ relative to the vertical. The second motor 81, 83 drives the forearm 86, 87 in rotation relative to the arm 84, 85 about a secondary oblique axis $O'_{01}$, $O'_{02}$ offset to the vertical by a secondary angle $\alpha'_{01}$, $\alpha'_{02}$ greater than the primary angle $\alpha_{01}$, $\alpha_{02}$. The primary and secondary axes of each motor pair are on respective opposite sides of the vertical.

The terminal, in which the lens is mounted on a support separate from that of the primary sources, can further include an additional motor 90 for driving the support of the lens so that it is disposed substantially parallel to the beams.

Figure 15A:
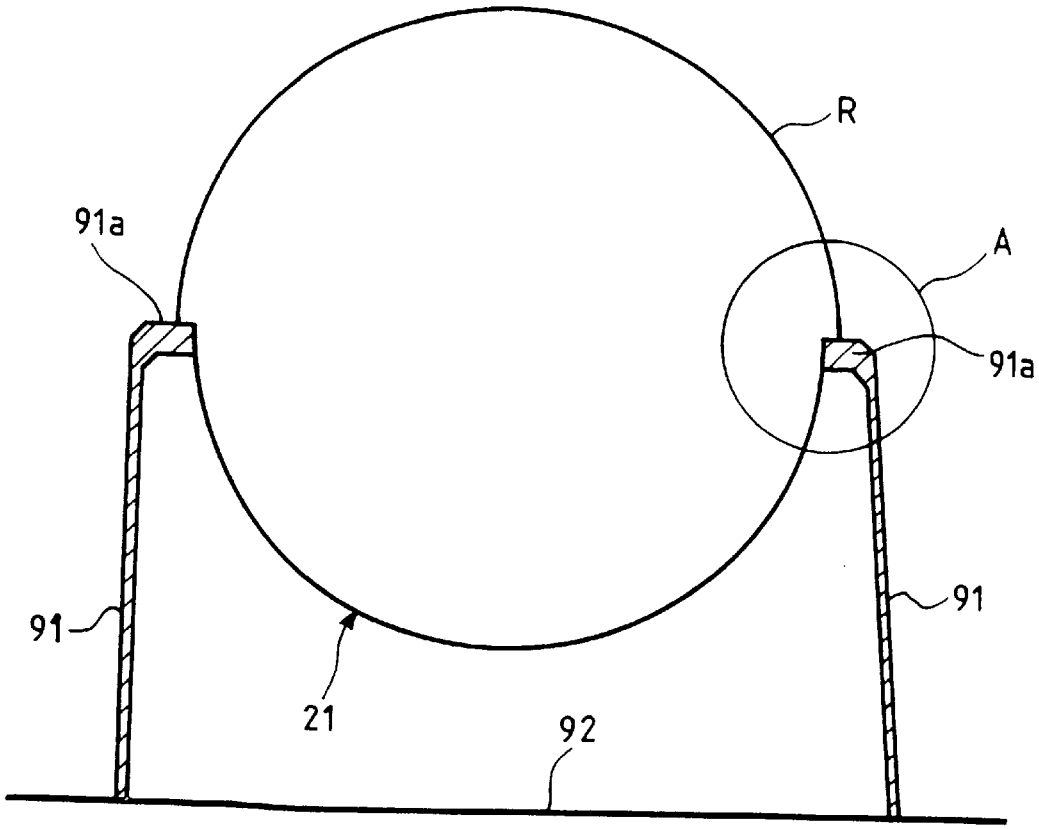
FIG. 15*a* is a diagrammatic sectional view of one embodiment of the lens support.
Figure 15B:
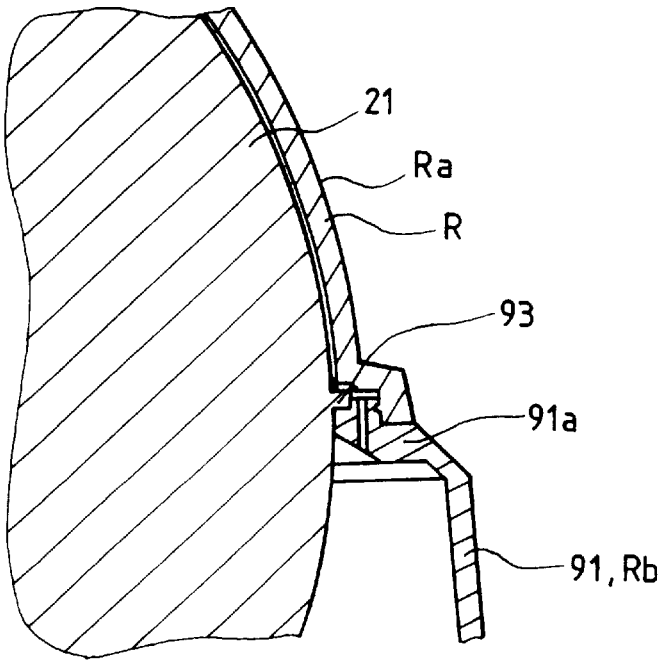
FIG. 15*b* is a view of the portion A of FIG. 15*a* to a larger scale.

In another embodiment of the invention (FIGS. 15*a* and 15*b*) the support for the lens 21 is a substantially cylindrical ring 91 mechanically coupled to the lens and fixed to a platform 92. In this embodiment of the invention the platform 92 is fixed and is used in particular to install the terminal on the dwelling or the land on which it is to be used.

The two arms 84, 85 of the primary sources (FIGS. 13 and 14) are then fixed to the platform 92 either directly or via the additional motor 90 which in this case does not drive the lens. This configuration confers an additional degree of freedom on the primary sources for tracking satellites.

The means for mechanically coupling the lens to the ring 91 include a flange 93 on the periphery of the lens. The flange 93 can be molded in one piece with the lens, for example, in particular in the central area of the sphere.

The flange 93 cooperates with the ring 91 which to this end has a cranked end 91*a* on which the flange 93 bears.

The ring 91 can be part of the radome R as previously described, in particular with reference to FIG. 8. To this end the radome R has an upper part Ra and a lower part Rb. The lower part Rb forms the ring 91.

In the embodiment of the invention previously described, the flange 93 of the lens 21 then bears on the lower part Rb. In this case, the upper part Ra can be replaced by a thin, thermoformed plastics material envelope that is rigid enough for its protection function.

Of course, the invention is not limited to the examples previously described but can be applied to other embodiments, for example scanning active antennas, and more generally to any embodiment using one or more means equivalent to the means described to fulfill the same functions to obtain the same results, such that, for example, each primary source, mounted on a support, is moved by at least one pair of motors so as to move each source over at least the lower half of the focal sphere.

What is claimed is:

1. A multilayer focusing sperical lens adapted to be mounted in a transceive antenna device of a remote transceiver system and having a concentric focal sphere comprising:

a two-layer lens structure, including:

a central layer and a peripheral layer having different dielectric constants, a value of each dielectric constant being determined so that the lens focuses parallel microwave rays towards the focal sphere concentric with the lens.

2. A focusing lens according to claim 1, wherein each dielectric constant value is optimized so that paths of rays representing propagation of a microwave energy are equal.

3. A focusing spherical lens according to claim 1, wherein each dielectric constant value is determined so that a power density between two consecutive rays is constant.

4. A focusing spherical lens according to claim 1, wherein each dielectric constant value is determined so that reflections at an interface between the two layers are weak.

5. A focusing spherical lens according to claim 1, further comprising an index matching layer added around said two-layer lens structure, said index matching layer being adapted to reduce losses by reflection at a lens dielectric/air interface.

6. A focusing spherical lens according to claim 5, wherein the index matching layer is of the quarter-wave type.

7. A focusing spherical lens according to claim 1, wherein the layers contain a low-loss material.

8. A focusing spherical lens according to claim 1, wherein the central layer is made of glass.

9. A focusing spherical lens according to claim 1, wherein at least one of the two layers, and in particular the peripheral layer, contains a dielectric material with a variable dielectric constant, such as a foam charged with calcium or barium titanate and/or miniature balls of metallized glass.

10. A focusing spherical lens according to claim 1, values of the dielectric constants of the two layers are in a range from 2 to 5.

11. An antenna for transmitting and receiving radio signals to and from at least one remote transceiver system moving in a field of view of said antenna, comprising a focusing spherical lens according to claim 1.

12. A transceive antenna according to claim 11, comprising at least one primary source for transmitting and receiving signals in a form of quasi-spherical wave beams which are mobile over a portion of the focal sphere, and means for slaving a position of each primary transceive source to a known position of a remote transceiver system.

13. A multilayer focusing spherical lens, adapted to be mounted in a transceive antenna device of a terminal of a remote transceiver system and having a concentric focal sphere, comprising:

a central layer, and a peripheral layer having different dielectric constants, a value of each dielectric constant being determined so that the lens focuses parallel microwave rays towards the focal sphere concentric with the lens; and an index matching layer added around said two-layer lens structure, said index matching layer being adapted to reduce losses by reflection at a lens dielectric/air interface;

wherein the index matching layer is of the quarter-wave type;

wherein the index matching layer is made of a dielectric material having an index equal to a square Root of an index of a dielectric material of the peripheral layer.

14. A multilayer focusing spherical lens adapted to be mounted in a transceive antenna device of a terminal of a remote transceiver system and having a concentric focal sphere, comprising:

a central layer and a peripheral layer having different dielectric constants, a value of each dielectric constant being determined so that the lens focuses parallel microwave rays towards the focal sphere concentric with the lens; and an index matching layer added around said two-layer lens structure, said index matching layer being adapted to reduce losses by reflection at a lens dielectriclair interface;

wherein the index matching layer is of the quarter-wave type;

wherein the index matching layer has a thickness equal to one quarter of a wavelength used and is pierced with a plurality of blind holes with a density of piercing adapted to create an equivalent index equal to a square root of an index of a dielectric material of the peripheral layer.

15. A terminal for transmitting and receiving radio signals to and from at least two remote transceiver systems moving at different points in a field of view of said terminal, comprising:

means for determining a position of said remote transmitters/receiver in view at a given time, means for choosing a remote transceiver, a transceive antenna for transmitting and receiving radio signals to and from at least one remote transceiver system moving in a field of view of said transceive antenna, comprising a focusing spherical lens having a concentric focal sphere, said focusing spherical lens including a central layer and a peripheral layer having different dielectric constants, a value of each dielectric constant being determined so that the lens focuses parallel microwave rays towards the focal sphere concentric with the lens;

said transceive antenna including at least one primary source for transmitting and receiving signals in a form of quasi-spherical wave beams which are mobile over a portion of the focal sphere, and means for slaving a position of each primary transceive source to a known position of the remote transceiver system, said transceive antenna including at least two primary transceive sources, means for controlling movement of the primary transceive sources over the focal sphere adapted to prevent the primary sources colliding and means for switching between the primary sources.

16. A terminal according to claim 15, further comprising means for recovering data lost during a switching time.

17. A terminal according to claim 15, wherein the primary sources take the form of horn antennas mobile over a portion of a focal.

18. A terminal according to claim 15, wherein each of the primary sources is mounted on a support and moved by at least one pair of motors so that each of the sources is moved over at least a lower half of the focal sphere.

19. A terminal according to claim 18, wherein the lens is mounted on a support separate from that of the primary sources, and said terminal further comprises an additional motor adapted to drive the support of the lens so that it is substantially parallel to the beams.

20. A terminal according to claim 18, wherein each of the primary sources is moved by a pair of azimuth/elevations motors.

21. A terminal according to claim 20, wherein each primary source support includes respective swing means on which each respective primary source is fixedly mounted, each swing of said swing means being moved along an axis by a respective azimuth motor of the motor pair and relative to a vertical by a respective inclination motor which is the other motor of that pair.

22. A terminal according to claim 20, wherein each primary source support includes an arm forming a circular arc concentric with the focal sphere, positioned on a respective half of a lower part of the focal sphere, each arm being moved in azimuth by a respective azimuth motor of the motor pair and each of the primary sources being moved along an arc by the other respective motor of the motor pair.

23. A terminal according to claim 18, wherein each of the primary sources is moved by an X/Y motor pair, a first motor of said motor pair rotating each of the primary sources about a horizontal primary axis Ox and a second motor of said motor pair rotating each of the primary sources about a secondary axis Oy orthogonal to said primary axis at all times and moved relative to the primary axis by the first motor.

24. A terminal according to claim 18, wherein a first one of the primary sources is moved by an azimuth/elevation motor pair and the second one of the primary sources is moved by an X/Y motor pair, an azimuth motor of the azimuth/elevation motor pair of the first one of the primary sources also driving the antenna as a whole.

25. A terminal according to claim 18, wherein each of the primary sources is moved by a pair of motors with oblique rotation axes.

26. A terminal according to claim 25, wherein each primary source support includes an arm and a forearm, each one of the primary sources is fixed to a free end of the respective forearm, a first motor of said pair of motors with oblique rotation axes drives the respective arm in rotation about an oblique primary axis offset to a vertical at a primary angle, a second motor of said pair of motors with oblique rotation axes drives the respective forearm in rotation relative to the respective arm about an oblique secondary axis offset to the vertical at a secondary angle greater than the primary angle, primary and secondary axes of each motor pair are on respective opposite sides of the vertical.

27. A terminal according to claim 15, wherein at least one primary source of said primary sources includes a module for amplifying transmitted and received signals.

28. A terminal according to claim 27, wherein the remote transmitters/receivers are satellites of a constellation and in that the means for determining the position of the satellites visible at a given time comprises:

a database of orbital parameters of each satellite at a given time, terminal position terrestrial parameter storage means, software for computing a current position of each satellite from initial orbit parameters and a time that has elapsed since an initial time, software for comparing an orbital position with an angular area visible from a position of the terminal, and means for regularly updating the satellite orbital parameter database.

29. A terminal according to claim 15, further comprising a primary source pointed at a remote transceiver system which is fixed in a field of view of the antenna.

30. A multilayer focusing spherical lens adapted to be mounted in a transceive antenna device of a terminal of a remote transceiver system and having a concentric focal sphere, comprising:

a two-layer lens structure, including:

a central layer and a peripheral layer having different dielectric constants;

wherein only said central layer and said peripheral layer with said different dielectric constants are required to refract paths of parallel microwave rays which enter said peripheral layer and said central layer, in order to focus said rays towards the focal sphere which is concentric with the lens.

* * * * *